United States Patent [19]

McWhorter

[11] 4,073,082

[45] Feb. 14, 1978

[54] TRUCK BUMPER ATTACHMENT

[76] Inventor: Delmer L. McWhorter, P.O. Box 220, North Vernon, Ind. 47265

[21] Appl. No.: 712,050

[22] Filed: Aug. 6, 1976

[51] Int. Cl.[2] ..... G09F 7/20

[52] U.S. Cl. ..... 40/591; 40/601; 40/155; 40/611; 40/603

[58] Field of Search ..... 40/129 C, 209, 155, 40/152, 152.1, 125 H, 125 G, 128

[56] References Cited

U.S. PATENT DOCUMENTS

| | | | |
|---|---|---|---|
| 1,218,761 | 3/1917 | Grant | 40/155 X |
| 2,431,108 | 11/1947 | Carleton et al. | 40/129 C |
| 2,494,179 | 1/1950 | King | 40/129 C |
| 2,524,216 | 10/1950 | Weissman | 40/155 X |
| 2,681,030 | 6/1954 | Hoge | 40/125 H X |
| 2,954,627 | 10/1960 | Kies | 40/125 G |

*Primary Examiner*—John F. Pitrelli
*Attorney, Agent, or Firm*—Blair & Brown

[57] ABSTRACT

A truck bumper attachment for use with wideload signs, having spring urged telescoping C-clamps for fastening onto the truck bumper and also telescoping supports for the sign so as to be useful with a plurality of sign sizes.

1 Claim, 6 Drawing Figures

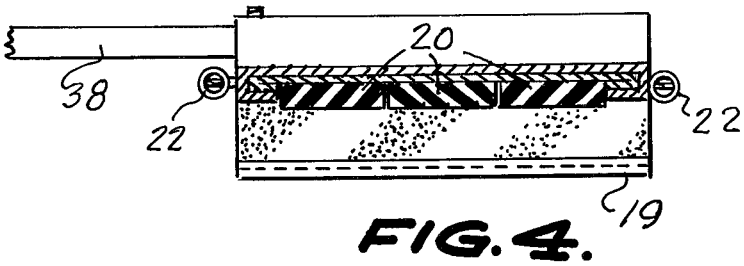
FIG. 4.
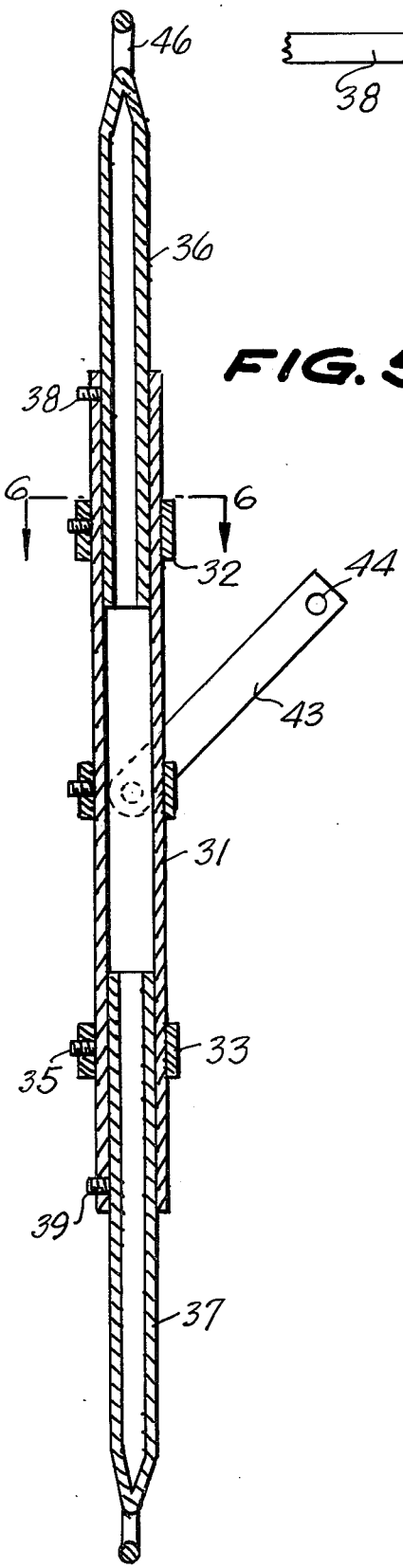
FIG. 5.
FIG. 6.
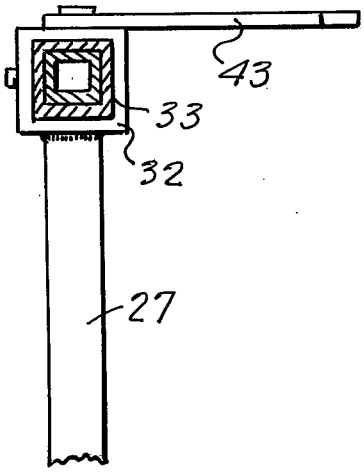

TRUCK BUMPER ATTACHMENT

BACKGROUND OF THE INVENTION

In the past, trucks have frequently been called upon to haul oversized loads, and in the cause of safety, when this is done, an oversized sign is required across the front of the truck to warn approaching traffic. Usually the large sign was then wrapped around the cab of the truck, most of the time covering the head lights and the bottom part of the radiator. Covering the headlights was obviously a safety hazard, and covering part of the radiator reduced cooling airflow needed to keep the engine from overheating. The present invention overcomes these disadvantages.

FIELD OF THE INVENTION

The present invention relates to a truck bumper attachment for mounting wideload signs.

SUMMARY OF THE INVENTION

The present invention of a truck bumper attachment includes a telescoping, adjustable clamp which can be adjusted to fasten over a truck bumper of almost any width and thickness. Once the clamps are attached to the bumper a vertically adjustable post at each end of the clamp is extended upward according to the size of the sign, and corners of the sign are then hung onto hooks at the extremity of the vertical posts.

The primary object of the invention is to provide an attachment means for easily, efficiently, and safely mounting a large sign onto the bumper of a truck.

Other objects and advantages will become apparent in the following specification when considered in light of the attached drawings.

BRIEF DESCRIPTION OF THE DRAWINGS

FIG. 4 is a view taken along the line 4—4 of FIG. 3, looking in the direction of the arrows;

FIG. 5 is a view taken along the line 5—5 of FIG. 1, looking in the direction of the arrows; and FIG. 6 is a view taken along the line 6—6 of FIG. 5, looking in the direction of the arrows.

DESCRIPTION OF THE PREFERRED EMBODIMENT

Figure 1:
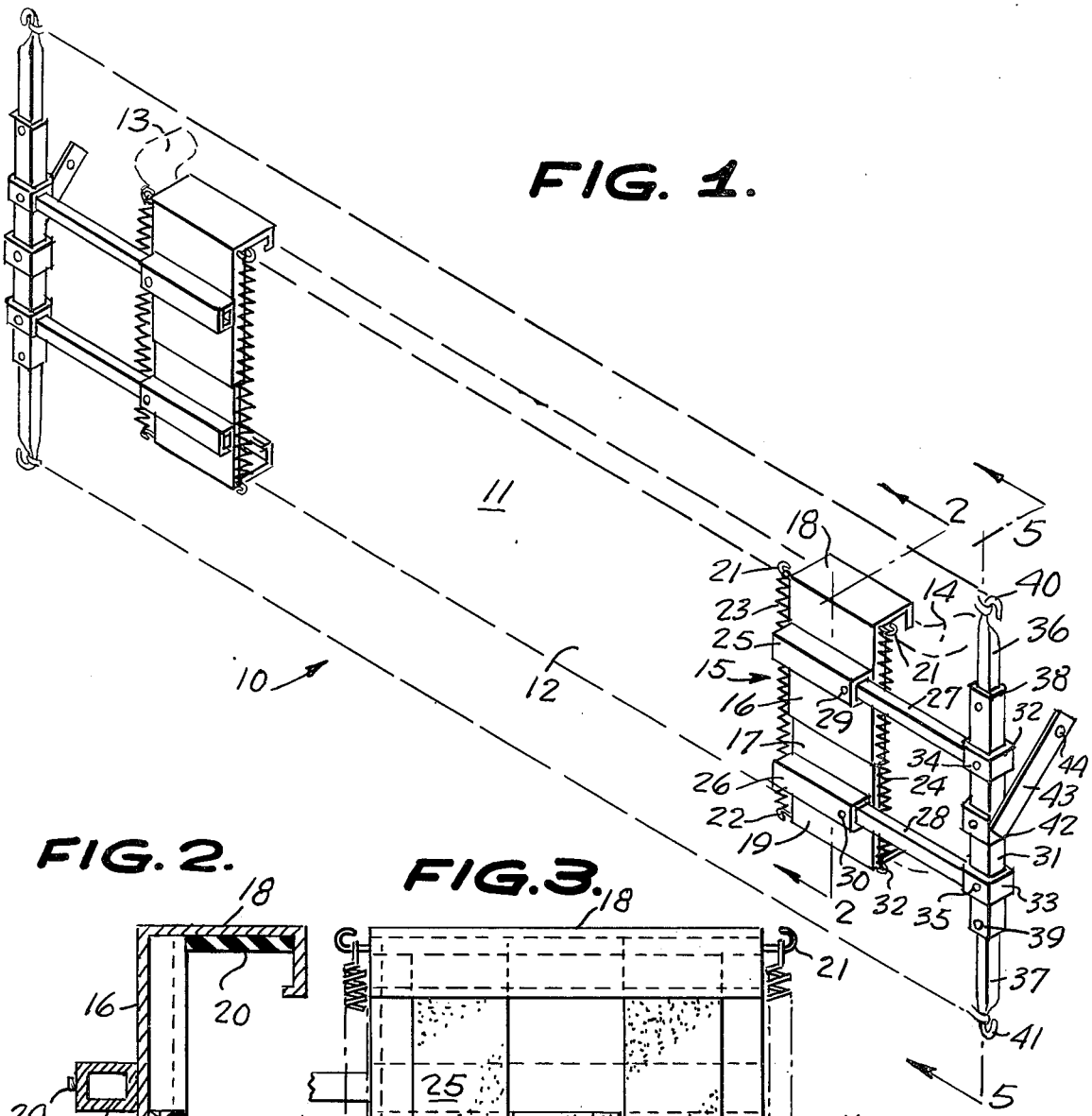
FIG. 1 is an overall perspective view of the invention when attached to a truck bumper.
Figure 2:
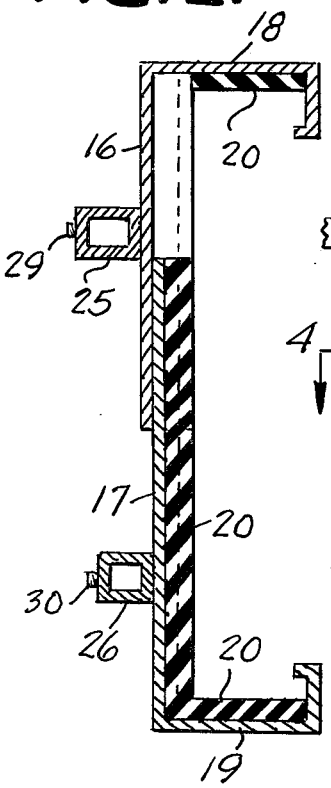
FIG. 2 is a view taken along the lines 2—2 of FIG. 1, looking in the direction of the arrows.
Figure 3:
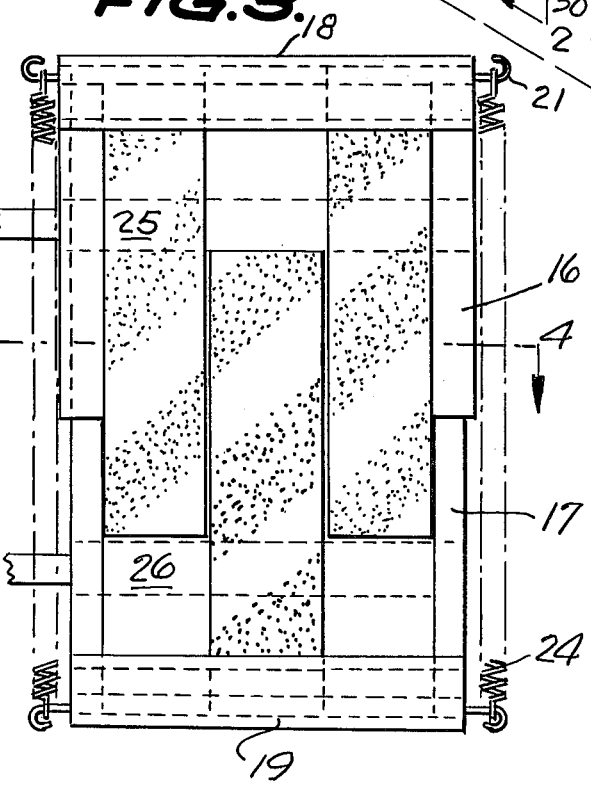
FIG. 3 is a front elevation view of one of the bumper clamps.

Referring now to the drawings in detail, wherein like reference characters indicate like parts throughout the several figures, the reference numeral 10 indicates generally a truck bumper attachment making up the invention, and fastened to a bumper indicated generally at 11.

The bumper 11, which may be either the front or rear of a truck, has a broad flat face 12, and two somewhat rounded ends 13 and 14.

Across the broad face 12 of bumper 11, and near the rounded ends 13 and 14, there is mounted a C-shaped bracket 15. The broad flat side of bracket 15 is made up of two interfitting halves 16 and 17 so that the bracket 15 can fit any sized bumper, the bracket having a curved upper end 18 and curved lower end 19 to overlap the respective sides of the bumper. On the inner side of ends 18 and 19 and even along bottom bracket 17 there may be a cushion material 20 to give a better grip onto bumper 11 and at the same time limit any marring at the connection.

Projecting out from the sides of ends 18 and 19 there are hooks 21 and 22 which serve as mountings for a pair of springs 23 and 24, these springs acting to pull ends 18 and 19 together to thereby hold bracket 15 onto bumper 11.

Horizontally welded to top half 16 and also to bottom half 17, there is a short hollow channel 25 and 26, these hollow channels 25 and 26 each have a movable plunger 27 and 28 that can be moved in and out of them and finally locked in place by means of set screws 29 and 30.

The outer ends of plungers 27 and 28 terminate in a vertical hollow channel 31, plungers 27 and 28 each having a collar 32 and 33 that encircle channel 31, the collars being fastened to the channel 31 by set screws 34 and 35.

In order to make the attachment of the invention adaptable to wide load signs of a variety of sizes, the pieces to which the sign is fastened must be adjustable. To do this sliding posts 36 and 37 move inside, and out of, the ends of vertical channel 31, and when the correct span of distance has been reached then the posts 36 and 37 are fastened in place by means of screws 38 and 39. The extreme ends of posts 36 and 37 are provided with a curved hook 40 and 41 for attachment of the wide-load sign.

Frequently, there arises the need for a special flag, or marker, to be mounted at the outer extremity of the wide-load sign. To provide for this eventuality there is another collar 42 fastened about midway along vertical channel 31, collar 42 having attached to it, at an angle, a short arm 43 with a hole 44 near its outer end. The staff of any flag, or special marker, is inserted through hole 44.

In the use and operation of the invention C-shaped bracket 15 is opened against springs 23 and 24, and the bracket is mounted over bumper 11 of the truck, the curved upper end 18 fitting across the top of the bumper, and curved end 19 being located at the bottom, so that when released, springs 23 and 24 draw the ends together to hold the bracket tightly on the bumper. Understandably, a similar bracket is mounted at each end of the bumper.

Once bracket 15 has been placed on the bumper, plungers 27 and 28 are slid out of channels 25 and 26 and finally locked by screws 29 and 30, so that the spread between the vertical channels 31 just fits the spread of the sign. After this, sliding posts 36 and 37 are pulled out of the ends of channel 31 until curved hooks 40 and 41 reach the outer corners of the sign, and finally screws 38 and 39 are fastened down to hold the posts firmly in place. Corners of the sign are hooked to curved hooks 40 and 41.

If there is need for a flag, or special poster, then its staff is inserted in hole 44 of short arm 43 which is attached to channel 31.

Having thus described the preferred embodiment of the invention it should be understood that numerous structural modifications and adaptations may be resorted to without departing from the spirit of the invention.

What is claimed is:

1. An attachment for truck bumpers to hold wide-load signs comprising "C" shaped clamp means for fastening the attachment to the bumper having cushion material on its innerface to prevent marring, hooks for securing the sign, means for adjusting the hooks according to the horizontal measurement of the sign, and means for adjusting the hooks according to the vertical measurement of the sign, said means for fastening the attachment to the bumper includes a pair of spring urged members for encircling the bumper; said horizontal adjustment includes a pair of hollow channels mounted on the attachment, a movable plunger in each channel and screws for fastening the plungers to the channels; said vertical adjustment includes another hollow channel mounted on the outer ends of the pair of plungers, hooks movable out of the top and bottom ends of the other channel, and screws for securing the hooks to the channel; and a short arm attached to said other channel for supporting a separate flag from the wide-load sign.

* * * * *